US010953442B2

(12) United States Patent
Bartek

(10) Patent No.: US 10,953,442 B2
(45) Date of Patent: Mar. 23, 2021

(54) HYDRAULIC CULVERT CLEANER

(71) Applicant: Diversified Products, LLC, Omaha, NE (US)

(72) Inventor: Jeff Bartek, Omaha, NE (US)

(73) Assignee: Diversified Products, LLC, Omaha, NE (US)

( * ) Notice: Subject to any disclaimer, the term of this patent is extended or adjusted under 35 U.S.C. 154(b) by 187 days.

(21) Appl. No.: 16/113,811

(22) Filed: Aug. 27, 2018

(65) Prior Publication Data

US 2020/0061680 A1 Feb. 27, 2020

(51) Int. Cl.

| | |
|---|---|
| ***B08B 9/032*** | (2006.01) |
| ***F03C 1/00*** | (2006.01) |
| ***F04B 53/10*** | (2006.01) |
| ***F04B 9/10*** | (2006.01) |

(52) U.S. Cl.

CPC ..... *B08B 9/0325* (2013.01); *F03C 1/002* (2013.01); *F04B 9/10* (2013.01); *F04B 53/1002* (2013.01); *B08B 2209/032* (2013.01)

(58) Field of Classification Search

CPC . B08B 9/0325; B08B 2209/032; F03C 1/002; F04B 9/10; F04B 53/1002

USPC ..... 134/168 R

See application file for complete search history.

(56) References Cited

U.S. PATENT DOCUMENTS

| | | | | |
|---|---|---|---|---|
| 2,491,562 A * | 12/1949 | Houtcooper | ..... | E03F 9/005 15/104.095 |
| 6,378,535 B1 * | 4/2002 | Miyachi | ..... | B08B 9/0321 134/102.1 |
| 6,761,135 B1 * | 7/2004 | Becktold | ..... | B08B 3/026 122/396 |
| 2006/0249185 A1 * | 11/2006 | Garman | ..... | B08B 9/0433 134/166 R |

OTHER PUBLICATIONS

BTE Culvert Cleaner System, viewed Dec. 2018.
Union Pacific Railroad Hydro Jet 1, posted Apr. 2018.

* cited by examiner

*Primary Examiner* — Tinsae B Ayalew
(74) *Attorney, Agent, or Firm* — Ballard Spahr LLP

(57) ABSTRACT

A culvert cleaner for cleaning clogged culverts using pressurized water having a self-contained water pump and maneuvering capabilities is described. The culvert cleaner includes a frame, a water pressurizing system, and a control system. The culvert cleaner may be used on a number of different machineries (e.g. truck, excavator, and rail equipment). The culvert cleaner is positioned in front of a clogged culvert using the hydraulic excavator that is on the railway. Once the culvert cleaner is position, the water pressurizing system of the culvert cleaner is engaged and high pressure water is used to clean the culvert. During cleaning alterations may be made to nozzle in the x-axis and y-axis due to the integrated positioning of the nozzle as a part of the water pressurizing system.

16 Claims, 9 Drawing Sheets

100

HYDRAULIC CULVERT CLEANER

BACKGROUND

Conventional culverts are used to allow the passage of water from one side of a blockage, which may be man-made (e.g. railroad, roadway) or naturally occurring to the other side of the blockage. This transfer of water prevents flooding or unwanted erosion at the blockage. One issue with conventional culverts is partial or complete clogging due to mud and other debris (e.g. sticks, leaves, rocks, and the like). Partially or completely clogged culverts may lead to flooding or erosion at the blockage, which may cause damage to the blockage (e.g. railroad or roadway). Therefore, it is necessary to have a means for cleaning (e.g. clearing the culvert of debris causing the blockage) clogged culverts.

Conventional methods for cleaning clogged culverts include augers and pressurized water. The conventional method of using an auger includes first accessing the clogged culvert so that the auger may enter the culvert horizontally. This horizontal access typically requires digging down to the opening of the culvert and clearing access outward from the culvert to accommodate the length of the auger for the auger to subsequently access the culvert. Moreover, actual deployment of the auger to clean the culvert is time consuming and may require up to three hours to complete clearing. Further, conventional augers are susceptible to clogging during the cleaning process, increasing the time required to complete cleaning and reducing the efficiency of cleaning.

Conventional methods of using pressurized water to clean clogged culverts include a mechanism for pressurizing water and a means to deliver it to the clogged culvert to clean it. Conventional pressurized water systems are faster than using an auger, but still have drawbacks. For example, some conventional pressurized water methods lack a self-contained water pump. The lack of a self-contained water pump requires that water must travel with the pressurized water cleaner. This reduces the efficiency of the pressurized water cleaner as additional machinery and power sources are required to power the water pump.

Further, conventional pressurized water systems lacking a self-contained water pump do not include a direct water feed to a nozzle of the pressurized water system. Systems that do not include a direct water feed to the nozzle reduce the amount of pressure at the nozzle in proportion to the distance from the nozzle to the water pressurizing pump. Finally, other conventional pressurized water systems are large in size making them difficult to maneuver and position directly adjacent to the opening of a clogged culvert. The lack of the ability to properly position the culvert cleaner may reduce efficiency and increase cleaning time, and it may lead to incomplete cleaning.

It is therefore desirable to have an apparatus for cleaning clogged culverts that is a pressurized water system, including a self-contained water pump. It is further desirable for the pressurized water system to include a direct water feed to the nozzle of the pressurized system. Finally, it is desirable for the pressurized water system to be of a size to allow maneuvering and proper positioning at the opening of a clogged culvert.

SUMMARY

In aspects of the invention a culvert cleaner for cleaning clogged culverts using pressurized water, including a frame, the frame comprising a central frame, a pump guard configured to protect a hydraulic motor, where the pump guard is in mechanical communication with the central frame and a push plate configured to maneuver the culvert cleaner, where the push plate is in mechanical communication with the central frame; a water pressurizing system to supply water to the culvert cleaner that is partially enclosed by the central frame, the water pressurizing system including a hydraulic circuit configured to power a water pump of the water pressurizing system; the water pump, where the water pump is in mechanical communication with the hydraulic circuit; an intake port, where the intake port is in mechanical communication with the water pump; piping configured to deliver pressurized water to a ball valve of the water pressurizing system, wherein the piping provides fluid communication between the water pump, the ball valve, and a nozzle, the ball valve, wherein the ball valves moves between an open position and a closed position, an electric motor, wherein the electric motor controls the movement of the ball valve between the open position and the closed position; a nozzle, wherein the nozzle delivers pressurized water to the clogged culvert; wherein the water pressurizing system is partially enclosed by the central frame; and a control system partially enclosed by the central frame, the control system including a control unit having a signal receiver, a wireless controller to transmit a signal to the control unit, and control lines, wherein the control system moves the ball valve between the open and the closed position.

In another aspect of the invention a culvert cleaner for cleaning clogged culverts using pressurized water, including a frame, the frame including a central frame; a pump guard configured to protect a hydraulic motor, where the pump guard is in mechanical communication with the central frame; a plate means for maneuvering the culvert cleaner, where the plate means is in mechanical communication with the central frame; a top hat, where the top hat is in mechanical communication with the central frame, and wherein the top hat is configured to permit removable attachment of the culvert cleaner to a machinery; a hydraulic plumbing weldment, where the hydraulic plumbing weldment is in mechanical communication with the top hat; a hydraulic hose clamp, where the hydraulic hose clamp is in mechanical communication with the top hat; and a light, where the light is in mechanical communication with the frame; a water pressurizing system to supply water to the culvert cleaner, the water pressurizing system including a hydraulic circuit configured to power a pump means for pressurizing water, the hydraulic circuit including a hydraulic motor, where the hydraulic motor is in mechanical communication with the frame; a first disconnect means for delivery machinery hydraulics to a delivery; and a second disconnect means for returning machinery hydraulics to a return hose, wherein the hydraulic motor, the first disconnect means, the delivery hose, the return hose, and the second disconnect means are in fluid communication; wherein the pump means for delivering water to the culvert cleanser, where the pump means is in mechanical communication with the hydraulic circuit; and an intake port, where the intake port is in mechanical communication with the pump means; and a pipe means for delivering pressurized water to a ball valve of the water pressurizing system; and the ball valve, wherein the ball valves moves between an open position and a closed position; an electric motor, wherein the electric motor controls the movement of the ball valve between the open position and the closed position; a nozzle, wherein the nozzle delivers pressurized water to the clogged culvert; and wherein the water pressurizing system is partially enclosed by the central frame; and a control system, the control system including a control unit having a signal receiver; a wireless controller for transmitting a control signal to the control unit; control lines; an x-axis motor, wherein the x-axis motor maneuvers the nozzle in the x-axis via the control signal from the wireless controller; a y-axis motor, wherein the y-axis motor maneuvers the nozzle in the y-axis via the control signal from the wireless controller; and wherein the control system moves the ball valve between the open and the closed position via the control signal to the electric motor, and wherein the control system is partially enclosed by the central frame.

In another aspect of the invention, a method of cleaning a clogged culvert with a culvert cleaner, the method including, positioning a culvert cleaner using a machinery; engaging a water pressurizing system of the culvert cleaner to supply water to the culvert cleaner, wherein the water pressurizing system is engaged by supplying a hydraulic circuit with hydraulic fluid from the machinery, wherein the hydraulic circuit powers a water pump via a hydraulic motor; positioning a nozzle of the culvert cleaner for cleaning the clogged culvert; opening a ball valve of the water pressurizing system to deliver pressurized water to the clogged culvert, wherein the ball valve is opened by an electric motor of the water pressurizing system.

DETAILED DESCRIPTION

A culvert cleaner for cleaning clogged culverts using pressurized water having a self-contained water pump and maneuvering capabilities is described. The culvert cleaner includes a frame, a water pressurizing system, and a control system. While it is to be understood that the culvert cleaner could be shown for use on a number of different machineries (e.g. truck, excavator, and rail equipment) it is disclosed here as being associated with a hydraulic excavator equipped with hi-rail gear (e.g. hydraulic excavator). The culvert cleaner is positioned in front of a clogged culvert using the hydraulic excavator that is on the railway. Once the culvert cleaner is position, the water pressurizing system of the culvert cleaner is engaged and high pressure water is used to clean the culvert. During cleaning alterations may be made to a nozzle in the x-axis and y-axis due to the integrated positioning of the nozzle as a part of the water pressurizing system.

Figure 1:
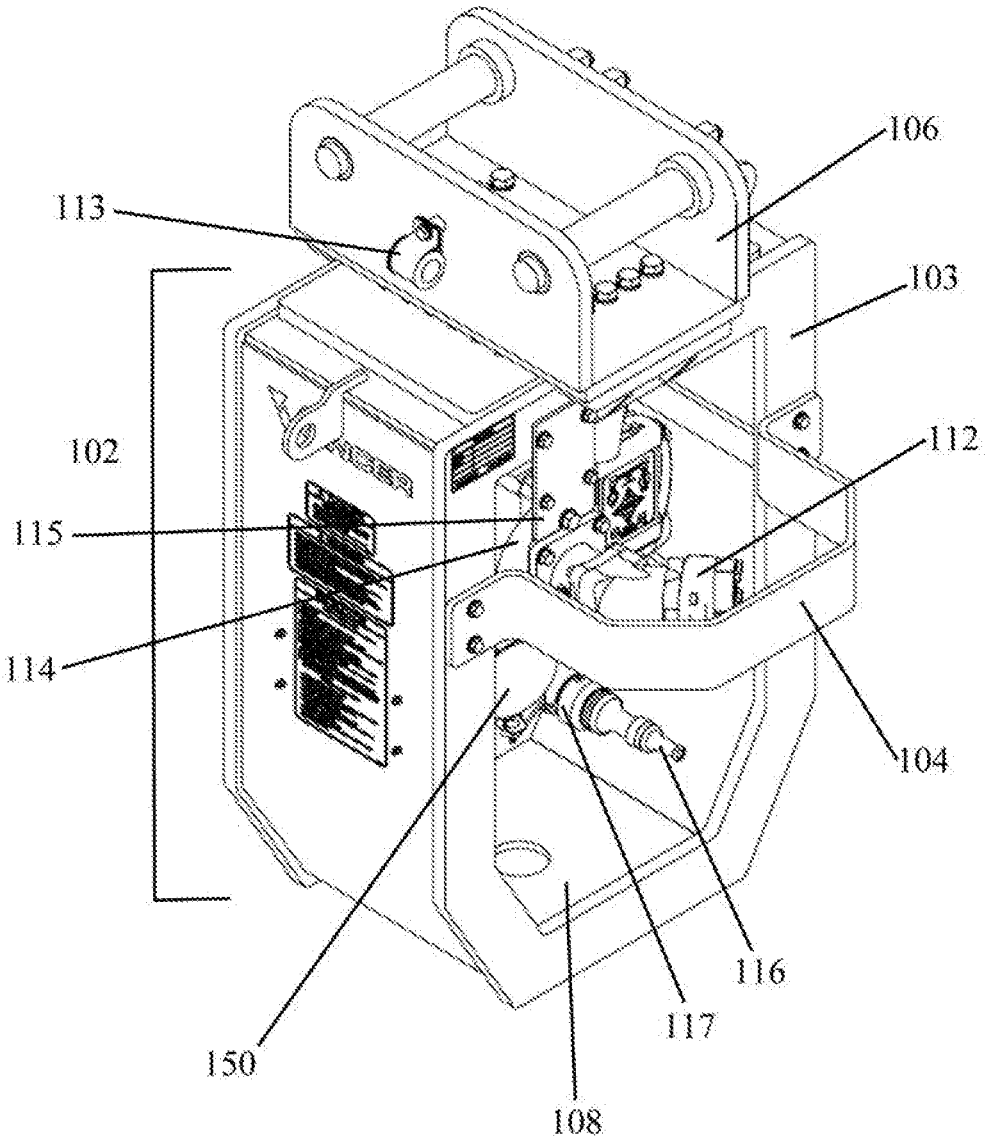
FIG. 1 represents a first front perspective view of a culvert cleaner.

FIG. 1 represents a front perspective view of a culvert cleaner 100. The culvert cleaner 100 includes a frame 102, a water pressurizing system 500 (not pictured, see FIG. 5), and a control system 600 (not pictured, see FIG. 6). The frame 102 includes a central frame 103, a pump guard 104 and a push plate 108. The frame 102 may further include a top hat 106, a hydraulic plumbing weldment 110 (not pictured), a hydraulic hose clamp 113, and a light 150.

The central frame 103 of the frame 102 at least partially encloses the water pressurizing system 500 and the control system 600. The central frame 103 may include a pump mount 115. The central frame 103 may be from 0.46 meters (m) to 1.07 m (1.5 feet to 3.5 feet) in length. Preferably, the central frame 103 is from 0.61 m to 0.91 m (2 feet to 3 feet) in length, and most preferably the central frame 103 is from 0.67 m to 0.84 m (2.25 feet to 2.75 feet) in length. The central frame 103 may be from 0.46 m to 1.07 m (1.5 feet to 3.5 feet) in width. Preferably, the central frame 103 is from 0.61 m to 0.91 m (2 feet to 3 feet) in width, and most preferably the central frame 103 is from 0.67 m to 0.84 m (2.25 feet to 2.75 feet) in width. The central frame 103 may be from 0.61 m to 1.52 m (2 feet to 5 feet) in height. Preferably, the central frame 103 is from 0.76 m to 1.37 m (2.5 to 4.5 feet) in height, and most preferably the central frame 103 is from 0.91 m to 1.22 m (3 to 4 feet) in height. The central frame may be of any structural material, such as steel, metal composites, or the like.

The pump mount 115 of the frame 102 is supports a water pump 114. The pump mount may be made of any structural material, such as galvanized steel, galvanized iron, or high-density polyethylene.

The pump guard 104 of the frame 102 is configured to protect a hydraulic motor 112 of the water pressurizing system 500 from debris. The pump guard 104 may partially surround a portion of the hydraulic motor 112 that extends past the central frame 103. The pump guard 104 is in mechanical communication with the central frame 103. The pump guard 104 may be in mechanical communication with the central frame via bolts. The pump guard 104 may be formed as a part of the central frame 103. The pump guard is made from any structural material, such as steel, metal composites, or the like.

The push plate 108 of the frame 102 permits maneuvering of the culvert cleaner 100. The push plate 108 is on a bottom of the frame 102 and may be a formed as a part of the central frame 103. The push plate 108 is preferably a solid piece of structural material that may contain one or more apertures. The push plate 108 provides a means for maneuvering the culvert cleaner 100 and the hydraulic excavator to which the culvert cleaner 100 is attached. The push plate 108 may be pressed into the ground via the hydraulic excavator that the culvert cleaner 100 is attached to, in order to maneuver (e.g. adjust) the culvert cleaner 100 for proper positioning for cleaning a clogged culvert. Further, pressing the push plate 108 into the ground may cause the front of the hydraulic excavator to lift, allowing maneuvering of the hydraulic excavator without moving (e.g. damaging) the railway. Such turning of the hydraulic excavator may be necessary to reposition the hydraulic excavator if the tracks on the hydraulic excavator become stuck. The push plate 108 may be of any structural material such as steel, metal composites, or the like.

The top hat 106 of the frame 102 is configured to attach the culvert cleaner 100 in mechanical communication to the hydraulic excavator. The top hat is from 0.15 m to 0.46 m (0.5 to 1.5 feet) in height. More preferably, the top hat 106 may be from 0.23 m to 0.38 m (0.75 feet to 1.25 feet) in height. Most preferably, the top hat 106 is from 0.24 m to 0.3 m (0.8 feet to 1 foot) in height. The top hat 106 includes an attachment configured to receive the corresponding connection on the hydraulic excavator. The top hat 106 is removably attached in mechanical communication with the top of the central frame 103 of the frame 102. The top hat 106 may be in mechanical communication via bolts. The top hat 106 is removably attached to permit attachment of a top hat 106 that permits attachment of the culvert cleaner 100 to the hydraulic excavator being used in connection with the culvert cleaner 100. The top hat 106 may be made of any structural material, such as steel, metal composites, or the like.

The hydraulic plumbing weldment 110 (see FIG. 2) of the frame 102 is configured to receive the hydraulic lines from the hydraulic excavator for connecting the water pressurizing system 500 of the culvert cleaner 100. The hydraulic plumbing weldment 110 may be in mechanical communication with the top hat 106. The hydraulic plumbing weldment 110 may be in mechanical communication via bolts, or the hydraulic plumbing weldment 110 may be formed as a part of the top hat 106. The hydraulic weldment may be made of any structural material, such as steel, metal composites, or the like.

The hydraulic hose clamp 113 of the frame 102 clamps the hydraulic lines from the hydraulic excavator to the water pressurizing system 500 of the culvert cleaner 100 to avoid the hydraulic lines from becoming tangled or damaged. The hydraulic hose clamp 113 may be in mechanical communication with the top hat 106. The hydraulic hose clamp 113 may be in mechanical communication via bolt, or the hydraulic hose clamp 113 may be formed as a part of the top hat 106. The hydraulic hose clamp may be made of any structural material, such as steel, metal composites, or the like.

The light 150 of the frame 102 is configured to light the culvert to assist in positioning the culvert cleaner 100 to achieve more efficient cleaning of the culvert. The light is in mechanical communication with the frame 102 via bolts, riveting, or a weld. The light 150 may be an incandescent lightbulb, a light emitting diode (LED), a compact fluorescent light bulb, or a halogen light.

Figure 2:
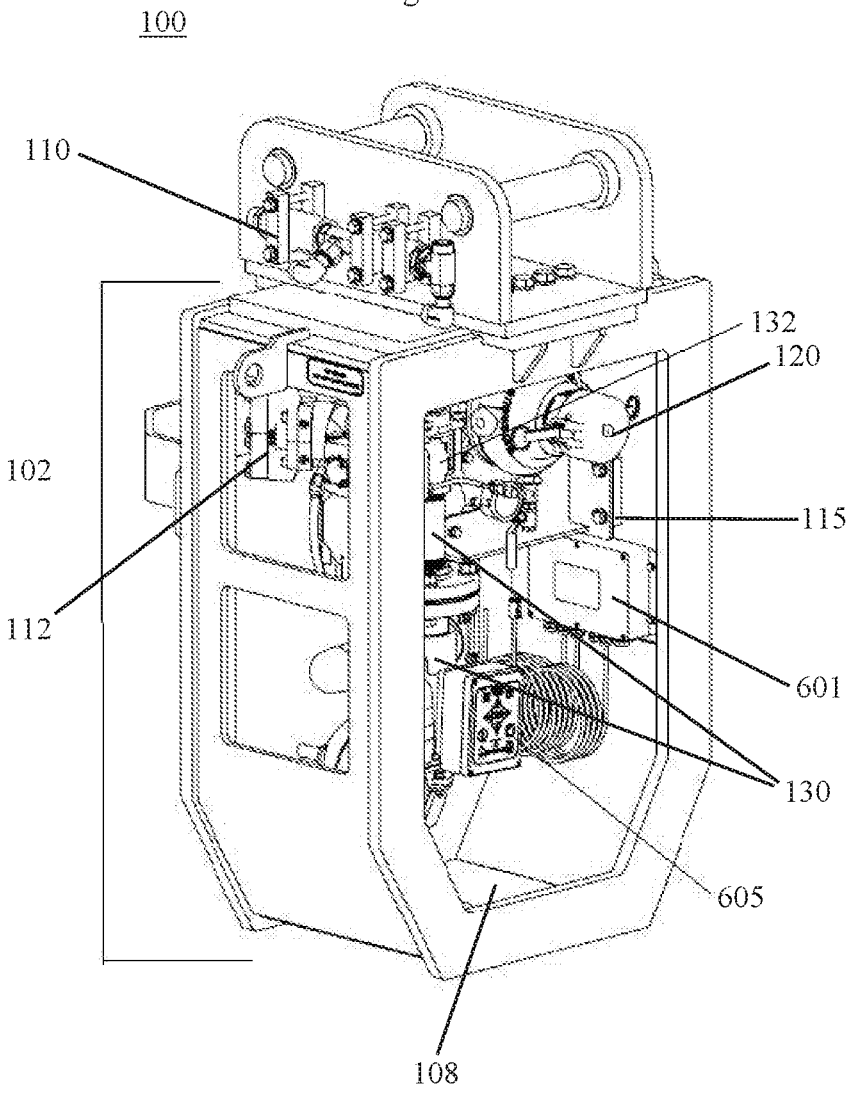
FIG. 2 represents a first back perspective view of the culvert cleaner.

FIG. 2 represents a first back perspective view of the culvert cleaner 100 having the frame 102, the water pressurizing system 500 and the control system 600. An electric motor 132, a hydraulic motor 112, an intake port 120, and piping 130 of the water pressurizing system 500 are shown. The intake port 120 is in mechanical communication with the water pump 114 (not shown). A control unit 601 and a manual electric motor controller 605 of the control system 600 are shown.

Figure 3A:
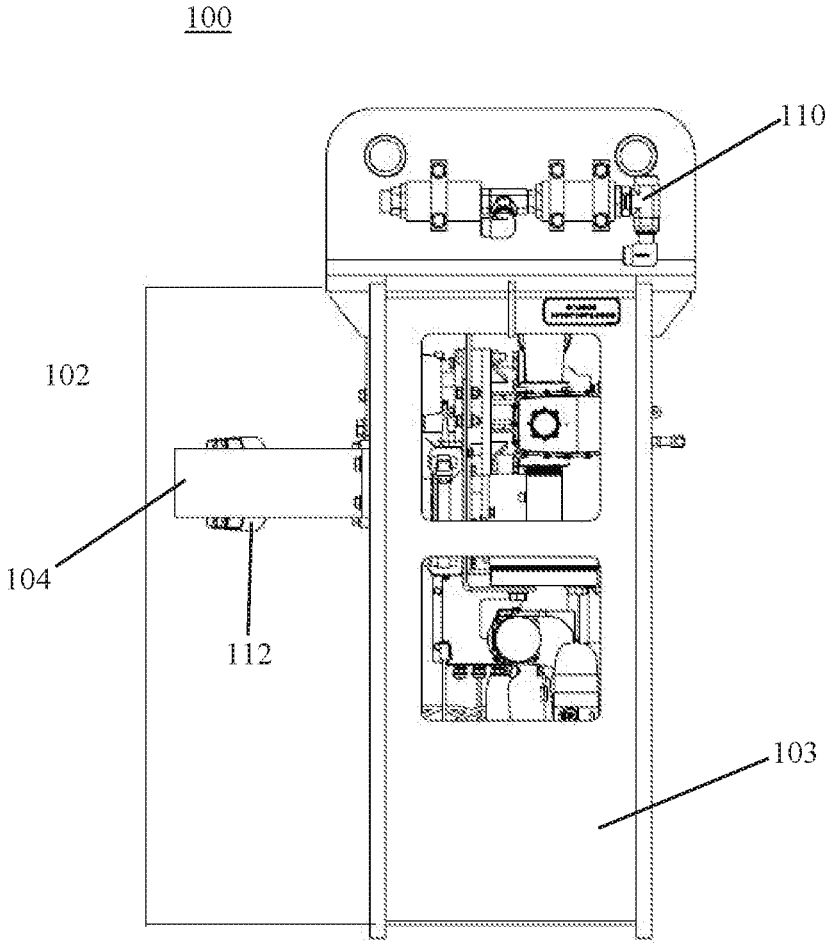
FIG. 3*a* represents a first side view of the culvert cleaner.

FIG. 3*a* represents a first side view of the culvert cleaner 100 having the frame 102, the water pressurizing system 500, and the control system 600 (not pictured). This first side view represents the pump guard 104 of the frame 102 partially surrounding the hydraulic motor 112 of the water pressurizing system 500.

Figure 3B:
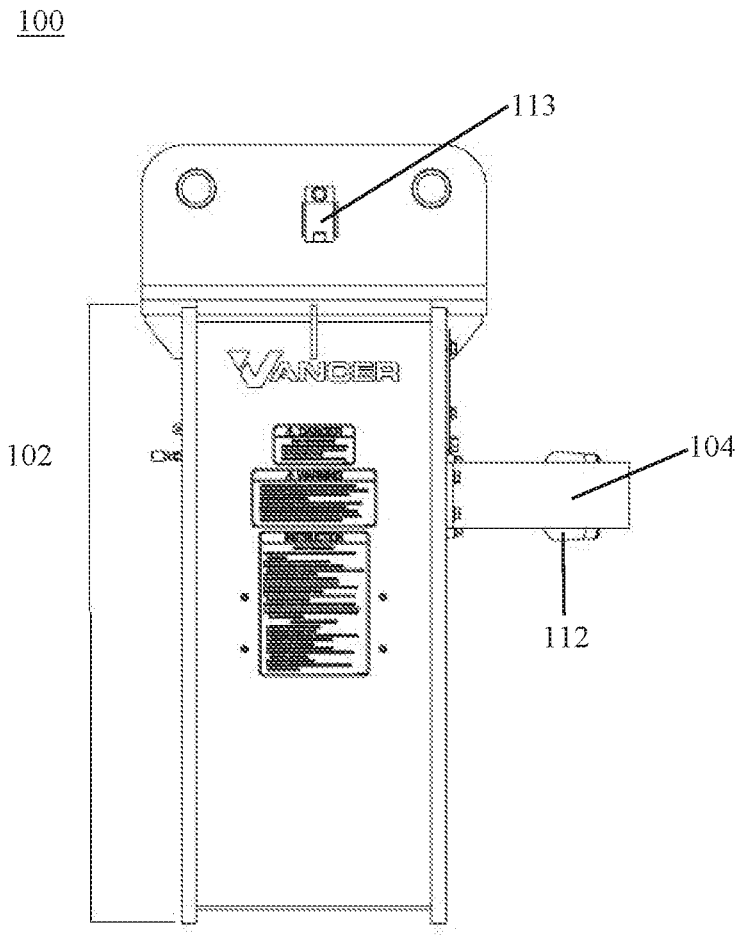
FIG. 3*b* represents a second side view of the culvert cleaner.

FIG. 3*b* represents a second side view of the culvert cleaner 100 having the frame 102, the water pressurizing system 500 and the control system 600 (not pictured). The second side view represents the pump guard 104 of the frame 102 partially surrounding the hydraulic motor 112 of the water pressurizing system 500.

Figure 4A:
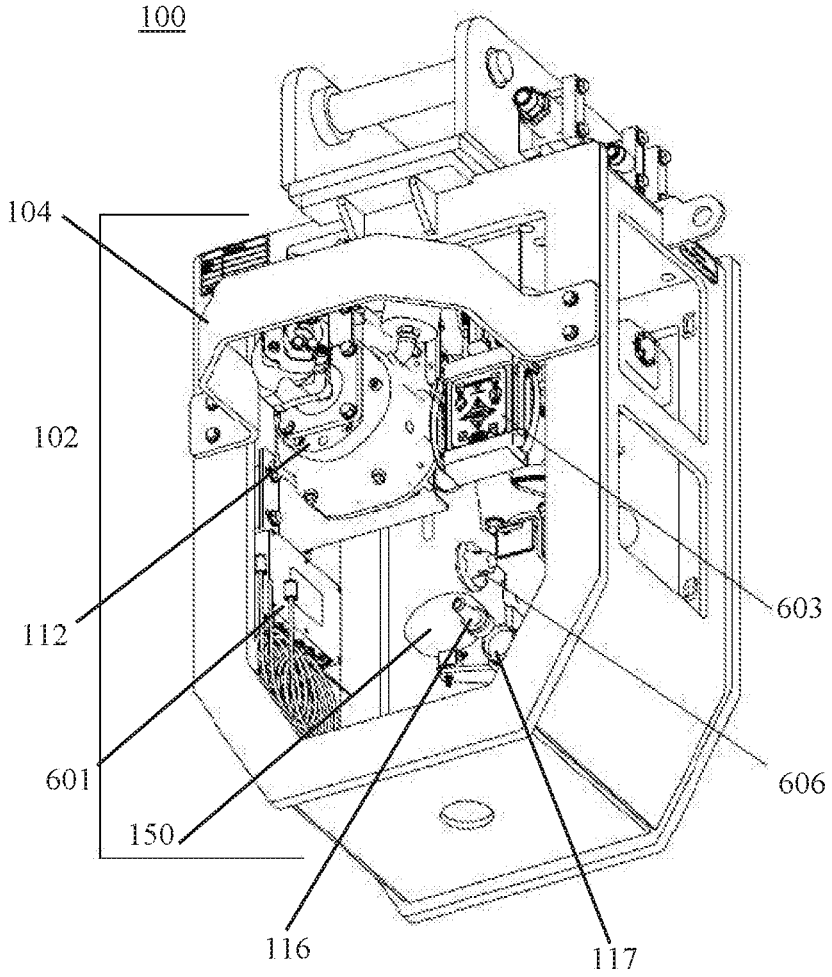
FIG. 4*a* represents a second front perspective view of a culvert cleaner.

FIG. 4*a* represents a second front perspective view of the culvert cleaner 100 having the frame 102, the water pressurizing system 500, and the control system 600. The hydraulic motor 112, a nozzle 116, and a ball valve 117 of the water pressurizing system 500 are shown. The control unit 601, an x-axis motor 606, a wireless controller 603 of the control system 600 are shown. The wireless controller 603 is shown in a storage position on the culvert cleaner 100, where the wireless controller is removably attached from the storage position for operation of the control system 600.

Figure 4B:
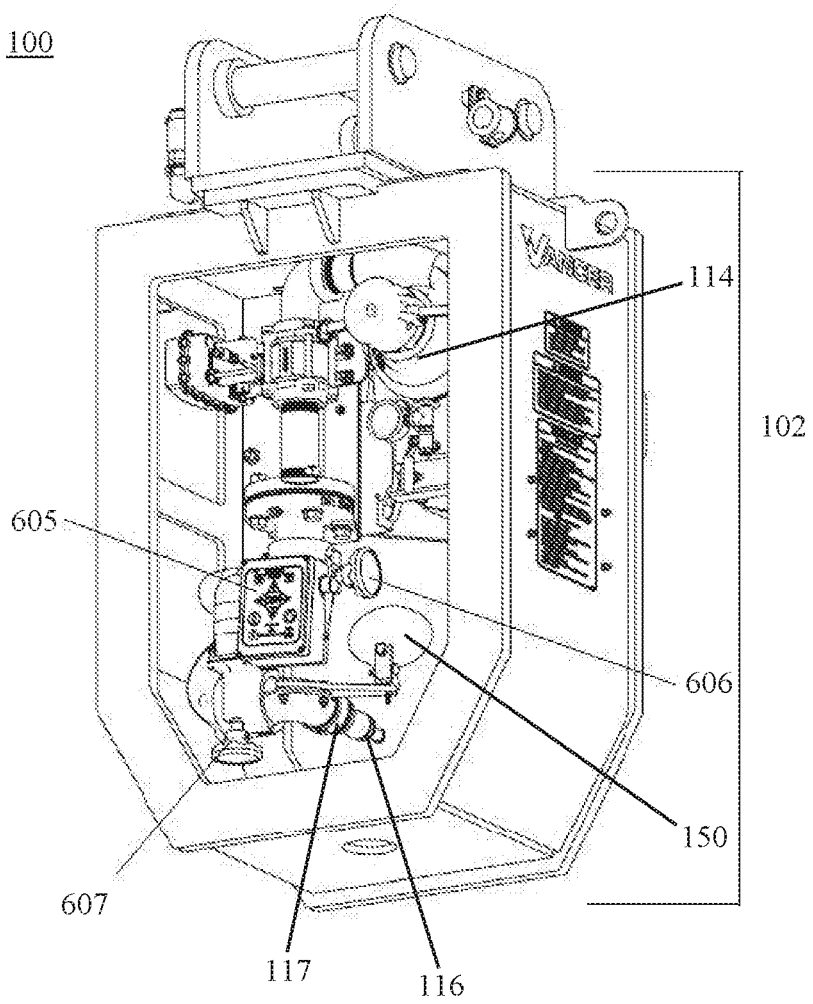
FIG. 4*b* represents a second back perspective view of a culvert cleaner.

FIG. 4*b* represents a second back perspective view of the culvert cleaner 100 having the frame 102, the water pressurizing system 500, and the control system 600. The nozzle 116, the ball valve 117, and a water pump 114 of the water pressurizing system 500 are shown. A manual controller 605 and a y-axis motor 607 of the control system 600 are shown.

Figure 5:
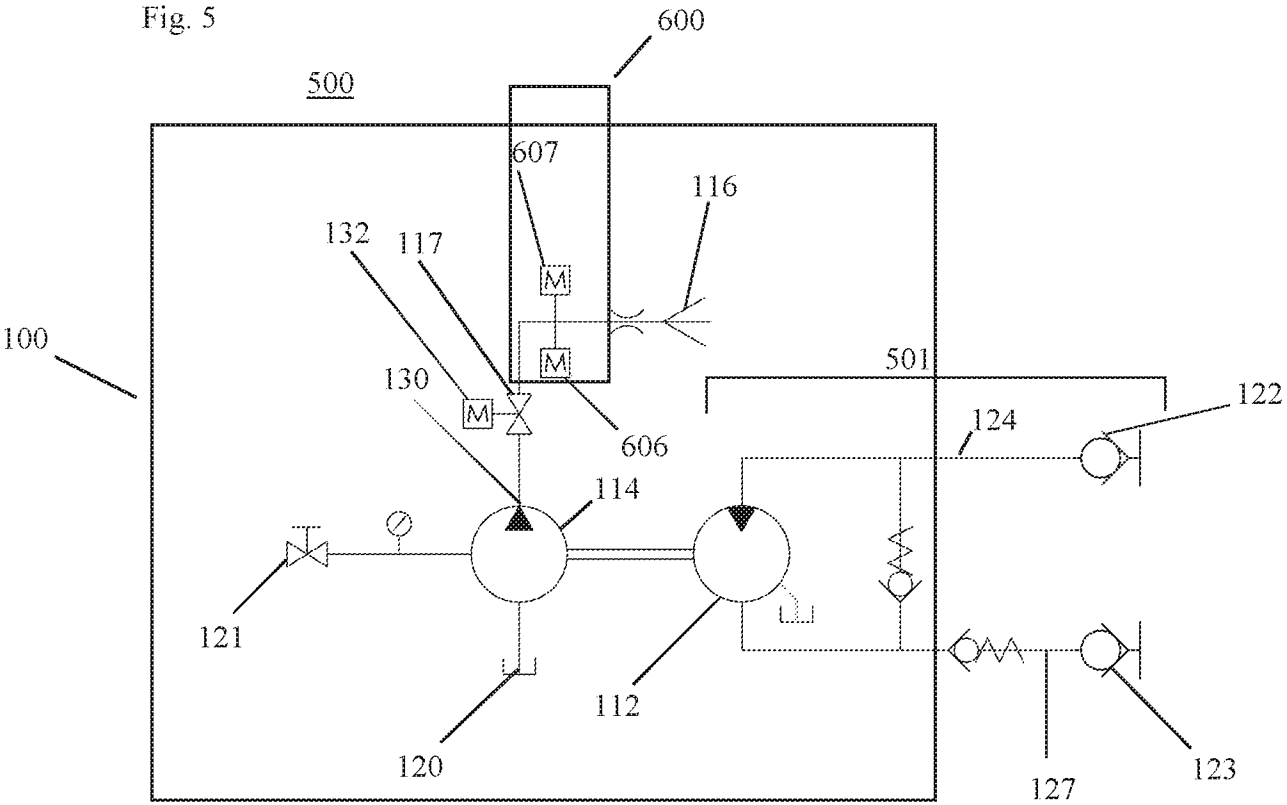
FIG. 5 represents a water pressurizing system of a culvert cleaner.

FIG. 5 represents a water pressurizing system 500 of the culvert cleaner 100 (where the culvert cleaner 100 is represented graphically. The water pressurizing system 500 supplies water to the culvert cleaner 100 and pressurizes the water for cleaning a culvert. The water pressurizing system 500 includes a hydraulic circuit 501, a water pump 114, an intake port 120, piping 130, an electronic motor 132, a ball valve 117, and a nozzle 116. The water pressurizing system 500 may include a needle valve 121.

The hydraulic circuit 501 is configured for powering the water pump 114 of the water pressurizing system 500 via hydraulic power of the hydraulic excavator (e.g. machinery hydraulics). The hydraulic circuit 501 includes a hydraulic motor 112, a first quick disconnect fitting 122, a delivery hose 124, a return hose 127, and a second quick disconnect fitting 123. The hydraulic motor 112, the first quick disconnect fitting 112, the delivery hose 124, the return hose 127, and the second quick disconnect fitting 123 are in fluid communication. The hydraulic circuit 501 is in fluid communication with the hydraulic circuitry of the hydraulic excavator.

The hydraulic circuit 501 is engaged by a control switch (not shown) on the hydraulic excavator to supply hydraulic fluid to the hydraulic circuit 501 via the first quick disconnect fitting 122. The delivery hose 124 provides pressurized hydraulic fluid to the hydraulic motor 112, where the hydraulic motor 112 turns the water pump 114. The hydraulic motor 112 returns the pressurized fluid to the machinery hydraulics via the return hose 127 and a second quick disconnect fitting 123.

The hydraulic motor 112 of the hydraulic circuit 501 is in mechanical communication with the frame 102 of the culvert cleaner 100. The hydraulic motor 112 is in mechanical communication with the delivery hose 124 and the return hose 127. The hydraulic motor 112 provides a means for powering the water pump 114. For example, the hydraulic motor 112 may be an axial piston motor providing displacement of 63 cubic centimeters per revolution.

The first quick disconnect fitting 122 of the hydraulic circuit 501 provides removable attachment of the machinery hydraulics to the hydraulic circuit 501. When connected to the hydraulic circuit 501, the first quick disconnect fitting 122 provides a means for delivering pressurized fluid from the machinery hydraulics to the delivery hose 124. The first quick disconnect fitting 122 may include a self-sealing valve.

The second quick disconnect 123 fitting of the hydraulic circuit 501 provides removable attachment of the machinery hydraulics to the hydraulic circuit 501. When connected to the hydraulic circuit 501, the second quick disconnect fitting 122 provides a means for returning pressurized fluid from the machinery hydraulics to the return hose 127. The second quick disconnect fitting 123 may include a self-sealing valve.

The water pump 114 of the water pressurizing system 500 delivers water from a water tank, which travels with but is not a part of the culvert cleaner 100, to the culvert cleaner 100. The water pump 114 further provides a means for pressurizing the water. The water pump 114 is in mechanical communication with the hydraulic circuit 501 via the hydraulic motor 112. The water pump 114 pumps water from the tank through the intake port 120, which may be a camlock fitting attachment. The water pump may be a single stage fire pump having a capacity of approximately 1136 liters per minute (300 gallons per minute) with a discharge pressure of approximately 14.1 kilograms per square centimeter (200 pounds per square inch). The water pump 114 is in further fluid communication with the piping 130.

The needle valve 121 of the water pressurizing system 500 improves priming of the water pump 114 and further draws water remaining in the water pump 114 out prior to storage of the culvert cleaner 100. The needle valve 121 is in mechanical communication with the water pump 114.

The piping 130 of the water pressurizing system 500 is configured to deliver the pressurized water to the ball valve 117 and the nozzle 116. The piping 130 is in mechanical communication with the frame 102 of the culvert cleaner. The piping 130 provides fluid communication for the pressurized water between the water pump 114, the ball valve 117, and the nozzle 116. The piping 130 may include a pipe flange, pipe nipple, and pipe adapter as a means for providing such communication of the water pump 114, the ball valve 117, and the nozzle 116. The piping 130 may be from 2.54 centimeters (cm) to 7.62 cm (1 to 3 inches) in diameter. Preferably the piping is from 3.81 cm to 6.35 cm (1.5 to 2.5 inches) in diameter. Most preferably, the piping is from 4.45 cm to 5.08 cm (1.75 to 2) inches in diameter. The piping may be made of any corrosion-resistant material, such as galvanized steel or galvanized iron. The piping 130 delivers the pressurized water to the ball valve 117.

The ball valve 117 of the water pressurizing system 500, in connection with the water pump 114, controls the flow of water to the nozzle 116. The ball valve 117 may have an internal diameter consistent with (e.g. equal to) the diameter of the piping 130. The ball value 117 may have an internal diameter less than the diameter of the piping 130 when a change in flow or pressure is desired. The ball valve 17 moves between an open position and a closed position. In the open position the ball valve 117 allows pressurized water to pass through via the piping 130 to the nozzle 116. In the closed position, the ball valve 117 blocks the flow of water in the piping 130 from traveling to the nozzle 116. The movement of the ball valve 117 between the open position and the closed position is controlled by the electric motor 132.

The electric motor 132 of the water pressurizing system 500 is configured to control the ball valve 117 from moving between an open position and a closed position. The electric motor 132 may be a 12 volt direct current electric motor. The electric motor 132 may be a 24 volt direct current electric motor. In the open position the water travels through the ball valve 117 via the piping 130 to the nozzle 116.

The nozzle 116 of the water pressurizing system 500 is configured to further pressurize the pressurized water for delivery to the clogged culvert to clean said culvert. The nozzle may deliver pressurized water at up to 14.1 kilograms per square centimeter (200 pounds per square inch). The nozzle may have an inlet of 1.5 national standard hose (NH). Further, the nozzle may have a 2.38 centimeter (0.9375 inch) and 1.27 centimeter (0.5 inch dual) stacked tips. The nozzle may move in the x-axis and the y-axis via the x-axis motor 606 and the y-axis motor 607 of the control system 600.

Figure 6:
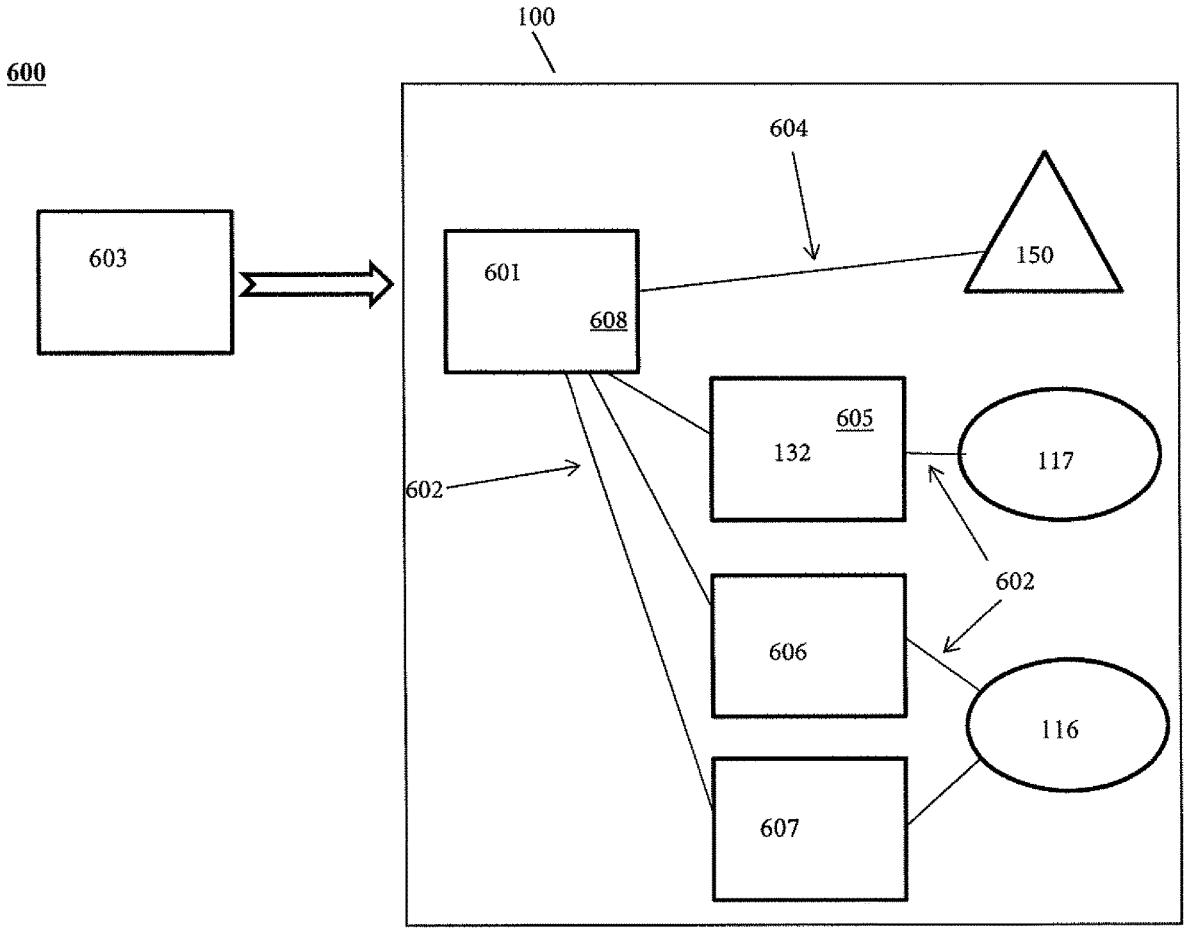
FIG. 6 represents a control system of the culvert cleaner.

FIG. 6 represents a control system of the hydraulic culvert cleaner 100. The control system 600 maneuvers the nozzle 116 in the x-axis and y-axis and the ball valve 117 to the open and the closed position. The control system 600 may further be configured to turn the light 150 on and off. The control system includes a control unit 601 having a signal receiver 608, a wireless controller 603, control lines 602, an x-axis motor 606 and a y-axis motor 607. The control system may include a light control line 604.

The wireless controller 603 transmits a control signal to the control unit 601. The wireless controller 603 may transmit the control signal from a distance of 152.4 m (500 feet) or less from the control unit 601 allowing operation of the culvert cleaner 100 at a distance safely away from the clogged culvert. The control signal is received by a signal receiver 608 of the control unit 601, where the control unit 601 controls the x-axis motor 606 and the y-axis motor 607 to maneuver the nozzle 116 in the x-axis and the y-axis, respectively in response to the control signal via the control lines 602. The control signal received by a signal receiver 608 of the control unit 601 may further control the electric motor 132 to move the ball valve 117 to the open and the closed position via the control lines 602. The control signal received by the signal receiver 608 of the control unit 601 may control the light 150 to turn the light on and off via the light control line 604.

The x-axis motor 606 and the y-axis motor 607 of the control system 600 may be stepper motors. The x-axis motor 606 and the y-axis motor 607 position the nozzle across at least plus or minus 30 degrees from center in the x-axis and across at least plus or minus 15 degrees from center in the y-axis, respectively. The x-axis motor 606 and the y-axis motor 607 may each have a manual control that permits positioning of the nozzle 116 through manual adjustment.

The control system 600 may include a manual electric motor controller 605 that manually controls the electric motor 132 to open and close the ball valve 117. The manual electric motor controller 605 is in electronic communication with the electric motor 132.

Figure 7:
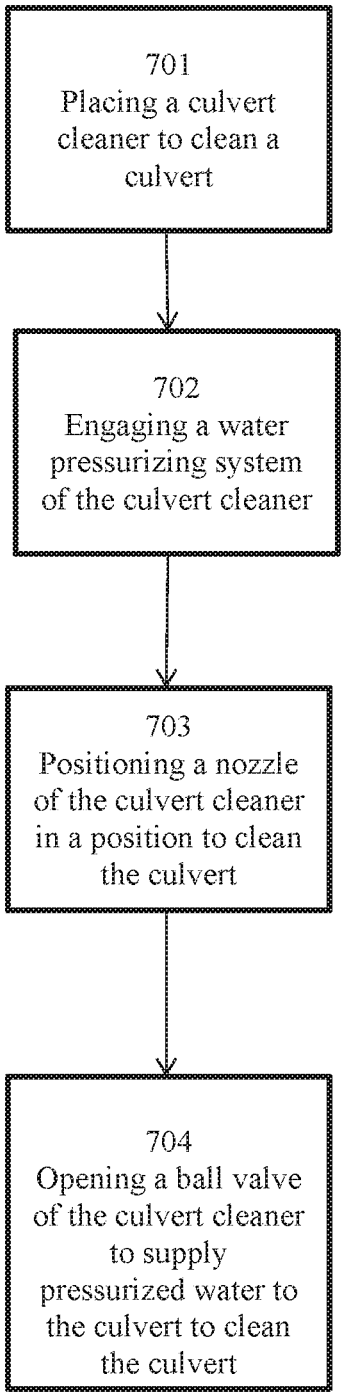
FIG. 7 represents a method for cleaning a culvert using the culvert cleaner.

FIG. 7 represents a method for cleaning a culvert using the culvert cleaner 100. In 701, the culvert cleaner 100 is placed using the hydraulic excavator for cleaning of a clogged culvert. The placing may include maneuvering of the hydraulic excavator using the push plate 108 of the culvert cleaner 100. The placing may further include placing the culvert cleaner 100 directly adjacent to the entrance of the clogged culvert.

In 702, the water pressurizing system is engaged to supply water to the culvert cleaner 100 and to pressurize the water for cleaning the clogged culvert. To engage the water pressurizing system 500, the hydraulic circuit 501 of the water pressurizing system 500 is engaged by a control switch on the hydraulic excavator to supply hydraulic fluid to the hydraulic circuit 501. The hydraulic circuit 501 powers the water pump 114 via the hydraulic motor 112. The water pump 114 delivers water to the water pressurizing system 500 through the intake port 120 and pressurizes the water, where the pressurized water travels through the piping 130 to the closed ball valve 117.

In 703, the nozzle of the culvert cleaner is positioned for cleaning the clogged culvert. Positioning the nozzle 116 includes maneuvering the nozzle with the control system 600 in the x-axis and the y-axis to align the nozzle with the clogged culvert. The wireless controller 603 transmits a control signal to the control unit 601 to move the nozzle 116 in the x-axis and y-axis. The control unit 601 controls the x-axis motor 606 and the y-axis motor 607 maneuver the nozzle 116 in the x-axis and y-axis, respectively, in response to the control signal. The positioning may further include turning the light 150 on and off via the control system 600.

The wireless controller 603 transmits a control signal to the control unit 601, which turns the light on and off via the light control line 604. Positioning the nozzle 116 may include manually controlling the x-axis motor 606 and the y-axis motor 607 via the manual knob controls.

In 704, the ball valve is opened to deliver pressurized water to clean the clogged culvert. The ball valve 117 is moved to the open position by the control system 600. The wireless controller 603 transmits a control signal to the control unit 601 to move the ball valve to the open position. The control line 601 controls the electric motor 132 to move the ball valve 117 to the open position. The ball valve 117 may be moved to the open position via the manual electric motor controller 605. In the open position pressurized water is delivered through the ball valve 117 and the piping 130 to the nozzle 116. The pressurized water 116 leaves the nozzle and cleans the clogged culvert. The cleaning may further include additional maneuvering of the nozzle 116 by the control system 600 to direct water to clogged portions of the culvert. Complete cleaning (e.g. unclogging) of the culvert may be done in an hour or less.

The invention claimed is:

1. A culvert cleaner for cleaning clogged culverts using pressurized water, comprising:
- a frame, the frame comprising:
  - a central frame;
  - a pump guard configured to protect a hydraulic motor, where the pump guard is in mechanical communication with the central frame; and
  - a push plate in mechanical communication with the central frame;
- a water pressurizing system to supply water to the culvert cleaner that is partially enclosed by the central frame, the water pressurizing system comprising:
  - a hydraulic circuit configured to power a water pump of the water pressurizing system;
  - the water pump, where the water pump is in mechanical communication with the hydraulic circuit;
  - an intake port, where the intake port is in mechanical communication with the water pump;
  - piping configured to deliver pressurized water to a ball valve of the water pressurizing system, wherein
    - the piping provides fluid communication between the water pump, the ball valve, and a nozzle;
  - the ball valve, wherein
    - the ball valve moves between an open position and a closed position;
  - an electric motor, wherein
    - the electric motor controls the movement of the ball valve between the open position and the closed position;
  - a nozzle, wherein
    - the nozzle delivers pressurized water to the clogged culvert;
  - wherein the water pressurizing system is partially enclosed by the central frame; and
- a control system partially enclosed by the central frame, the control system comprising:
  - a control unit having a signal receiver;
  - a wireless controller to transmit a signal to the control unit; and
  - control lines, wherein
  - the control system moves the ball valve between the open and the closed position.

2. The culvert cleaner of claim 1, wherein:
- the frame further comprises:
  - a top hat, where the top hat is in mechanical communication with the central frame, wherein
    - the top hat is configured to permit removable attachment of the culvert cleaner to a machinery;
  - a hydraulic plumbing weldment, where the hydraulic plumbing weldment is in mechanical communication with the top hat;
  - a hydraulic hose clamp, where the hydraulic hose clamp is in mechanical communication with the top hat; and
  - a light, where the light is in mechanical communication with the frame; and
- wherein
- the central frame further comprises a pump mount.

3. The culvert cleaner of claim 1, wherein
- the central frame is from 0.46 meters to 1.07 meters in length, from 0.46 to 1.07 meters in width, and 0.61 to 1.52 meters in height.

4. The culvert cleaner of claim 1, wherein
- the hydraulic circuit of the water pressurizing system, further comprises
  - a hydraulic motor, where the hydraulic motor is in mechanical communication with the frame,
  - a first quick disconnect fitting,
  - a delivery hose,
  - a return hose, and
  - a second quick disconnect fitting, wherein
- the hydraulic motor, the first quick disconnect, the delivery hose, the return hose, and the second quick disconnect are in fluid communication.

5. The culvert cleaner of claim 4, wherein
- the hydraulic motor of the hydraulic circuit is an axial piston motor having displacement of 63 cubic centimeters per revolution.

6. The culvert cleaner of claim 5, wherein
- the water pump of the water pressurizing system is a single stage fire pump having a capacity of approximately 1136 liters per minute and a displacement of approximately 14.1 kilograms per square centimeter.

7. The culvert cleaner of claim 1, wherein
- the ball valve of the water pressurizing system has an internal diameter consistent with the internal diameter of the piping, and wherein
- the electric motor of the water pressurizing system is a 12 volt direct current electric motor.

8. The culvert cleaner of claim 7, wherein
- the piping has a diameter from 2.54 to 7.62 centimeters.

9. The culvert cleaner of claim 6, wherein
- the electric motor of the water pressurizing system is a 24 volt direct current electric motor.

10. The culvert cleaner of claim 1, wherein
- the control system further comprises
  - an x-axis motor configured to maneuver the nozzle in the x-axis via the control signal from the wireless controller, and
  - a y-axis motor configured to maneuver the nozzle in the y-axis via the control signal from the wireless controller.

11. The culvert cleaner of claim 10, wherein
- the x-axis motor is configured to position the nozzle plus and minus 30 degrees from center in the x-axis; and wherein
- the y-axis motor is configured to position the nozzle plus and minus 15 degrees from center in the y-axis.

12. A culvert cleaner for cleaning clogged culverts using pressurized water, comprising:

a frame, the frame comprising a central frame;

a pump guard configured to protect a hydraulic motor, where the pump guard is in mechanical communication with the central frame;

a push plate in mechanical communication with the central frame;

a top hat, where the top hat is in mechanical communication with the central frame, and wherein the top hat is configured to permit removable attachment of the culvert cleaner to a machinery;

a hydraulic plumbing weldment, where the hydraulic plumbing weldment is in mechanical communication with the top hat;

a hydraulic hose clamp, where the hydraulic hose clamp is in mechanical communication with the top hat; and a light, where the light is in mechanical communication with the frame;

a water pressurizing system to supply water to the culvert cleaner, the water pressurizing system comprising a hydraulic circuit configured to power a pump for pressurizing water, the hydraulic circuit comprising a hydraulic motor, where the hydraulic motor is in mechanical communication with the frame;

a first disconnect fitting for delivering machinery hydraulics to a delivery; and a second disconnect fitting for returning machinery hydraulics to a return hose, wherein the hydraulic motor, the first disconnect fitting, the delivery hose, the return hose, and the second disconnect fitting are in fluid communication;

wherein the pump is for delivering water to the culvert cleanser, where the pump is in mechanical communication with the hydraulic circuit; and an intake port, where the intake port is in mechanical communication with the pump; and a pipe for delivering pressurized water to a ball valve of the water pressurizing system; and the ball valve, wherein the ball valves moves between an open position and a closed position;

an electric motor, wherein the electric motor controls the movement of the ball valve between the open position and the closed position;

a nozzle, wherein the nozzle delivers pressurized water to the clogged culvert; and wherein the water pressurizing system is partially enclosed by the central frame; and a control system, the control system comprising a control unit having a signal receiver;

a wireless controller for transmitting a control signal to the control unit;

control lines;

an x-axis motor, wherein the x-axis motor maneuvers the nozzle in the x-axis via the control signal from the wireless controller;

a y-axis motor, wherein the y-axis motor maneuvers the nozzle in the y-axis via the control signal from the wireless controller; and wherein the control system moves the ball valve between the open and the closed position via the control signal to the electric motor, and wherein the control system is partially enclosed by the central frame.

13. The culvert cleaner of claim 12, wherein the central frame is from 0.46 meters to 1.07 meters in length, from 0.46 to 1.07 meters in width, and 0.61 to 1.52 meters in height.

14. The culvert cleaner of claim 12, wherein the hydraulic motor of the hydraulic circuit is an axial piston motor having displacement of 63 cubic centimeters per revolution.

15. The culvert cleaner of claim 12, wherein the ball valve of the water pressurizing system has an internal diameter consistent with the internal diameter of the piping, and wherein the electric motor of the water pressurizing system is a 12 volt direct current electric motor.

16. The culvert cleaner of claim 12, wherein the electric motor of the water pressurizing system is a 24 volt direct current electric motor; and wherein the x-axis motor is a is configured to position the nozzle plus and minus 30 degrees from center in the x-axis; and wherein the y-axis motor is configured to position the nozzle plus and minus 15 degrees from center in the y-axis.

* * * * *